US009011175B2

(12) United States Patent
Xu et al.

(10) Patent No.: US 9,011,175 B2
(45) Date of Patent: Apr. 21, 2015

(54) INTERFERENCE FREE CONNECTOR SOCKET

(71) Applicant: Advanced-Connectek Inc., Taipei (TW)

(72) Inventors: Fu-Yi Xu, Taipei (TW); Wei Wan, Taipei (TW); Shu-Lin Duan, Taipei (TW); Sheng-Chan Lin, Taipei (TW)

(73) Assignee: Advanced-Connectek Inc., Taipei (TW)

( * ) Notice: Subject to any disclaimer, the term of this patent is extended or adjusted under 35 U.S.C. 154(b) by 128 days.

(21) Appl. No.: 13/937,692

(22) Filed: Jul. 9, 2013

(65) Prior Publication Data

US 2014/0017941 A1 Jan. 16, 2014

(30) Foreign Application Priority Data

Jul. 10, 2012 (CN) ..... 2012 2 0329777 U

(51) Int. Cl.
*H01R 13/648* (2006.01)
*H01R 13/658* (2011.01)
*H01R 13/6581* (2011.01)

(52) U.S. Cl.
CPC ..... *H01R 13/658* (2013.01); *H01R 13/6581* (2013.01)

(58) Field of Classification Search
CPC ..... H01R 13/658; H01R 13/6581
USPC ..... 439/607.04, 660
See application file for complete search history.

(56) References Cited

U.S. PATENT DOCUMENTS

2014/0073169 A1* 3/2014 Xu et al. ..... 439/345

* cited by examiner

*Primary Examiner* — Javaid Nasri
(74) *Attorney, Agent, or Firm* — Rabin & Berdo, P.C.

(57) ABSTRACT

A connector socket has an insulation body having thereon multiple terminals, a metal body having a receiving hole defined to receive therein the insulation body, spring clips formed on side faces thereof and having protrusions formed on the spring clips for extension and accommodation in the windows of the connector plug so as to enhance engagement with the connector plug and a protection casing for receiving therein the metal body and the insulation body to block electromagnetic interference to/from the terminals.

7 Claims, 6 Drawing Sheets

INTERFERENCE FREE CONNECTOR SOCKET

CROSS-REFERENCES TO RELATED APPLICATIONS

This non-provisional application claims priority under 35 U.S.C. §119(a) on patent application No. 201220329777.9 filed in China, P.R.C. on Jul. 10, 2012, the entire contents of which are hereby incorporated by reference.

BACKGROUND

1. Technical Field

The invention relates to an interference free connector socket and, more particularly, to a connector socket having multiple protrusions for engagement with a connector plug and a protection casing mounted outside a metal body to block interferences from the surroundings so as to maintain accurate data during transmission.

2. Related Art

Nowadays, as the advance of modem technology, various electronic devices are among our lives. In order to accomplish the designed purpose of information transmission, different connectors are become necessary to do the work. Because USB (Universal Serial Bus) is compact in size and has plug-in capability, it has been widely used in our daily routine. Currently, USB3.0 is the most popular type since it is the improvement version of the old USB2.0 to have better file format, lower energy consumption and high data transmission speed.

With reference to FIGS. 1, 2 and 3, a conventional connector socket 1 is shown and has an insulation body 11 and a metal casing 12. The insulation body 11 securely carries multiple terminals 111 thereon. The metal casing 12 is designed to have a connection hole 121 defined in a side face thereof to correspond to the insulation body 11 and at least one spring plate 122 formed on at least one side face thereof and having a bent 123 formed on a distal free end of the spring plate 122.

The insulation body 11 is securely inserted into a space inside the metal casing 12 from the connection hole 121 while carrying thereon the terminals 111. After the terminals 111 are securely connected to the insulation body 11 and the insulation body 11 together with the terminals 111 is inserted into the metal casing 12, the connector socket is ready for receiving a connector plug 2 having thereon windows 21 defined to correspond to the bent 123.

With reference to FIG. 3 especially, it is to be noted that after the connector plug 2 is inserted into the connector socket 1, the bents 123 align with the windows 21 of the connector plug 2 so that extension of the bents 123 into the corresponding windows 21 creates engagement therebetween.

Having the bents 123 engaged with the connector plug 2 by extension into the windows 21 results in bad engagement between the connector socket 1 and the connector plug 2 such that after the connector plug 2 is inserted into the connector socket 1 and data is being transmitted, electromagnetic signals is easily generated and influences the accuracy of data transmission.

SUMMARY

The primary objective of the present invention is to provide an interference free connector socket to maintain accuracy of data transmission.

In order to accomplish the aforementioned objective, the connector socket constructed in accordance with the present invention has an insulation body with terminals thereon, a metal body securely receiving therein the insulation body and a protection casing blocking interferences to/from the terminals so as to maintain the accuracy of data during transmission.

Another objective of the present invention is to provide multiple protrusions on side walls of the metal body to correspond to windows of the connector plug such that with the protrusions received in the windows of the connector plug, the engagement between the connector socket and the connector plug is enhanced.

In a preferred embodiment of the present invention, it is noted that the protrusions are semi-sphere.

In still another objective of the present invention, the metal body further has a baffle provided at one free end of the metal body.

Still another objective of the present invention is that the baffle is provided with clamping holes and the metal body has clamps so that when the clamps are received in the clamping holes, the baffle is securely connected to the metal body.

A further objective of the present invention is that the protrusions are formed on spring plates of the metal body such that when the connector plug is inserted into the metal body, force provided by the spring plate enhances the engagement strength of the protrusions to the connector plug.

DETAILED DESCRIPTION

Figure 1:
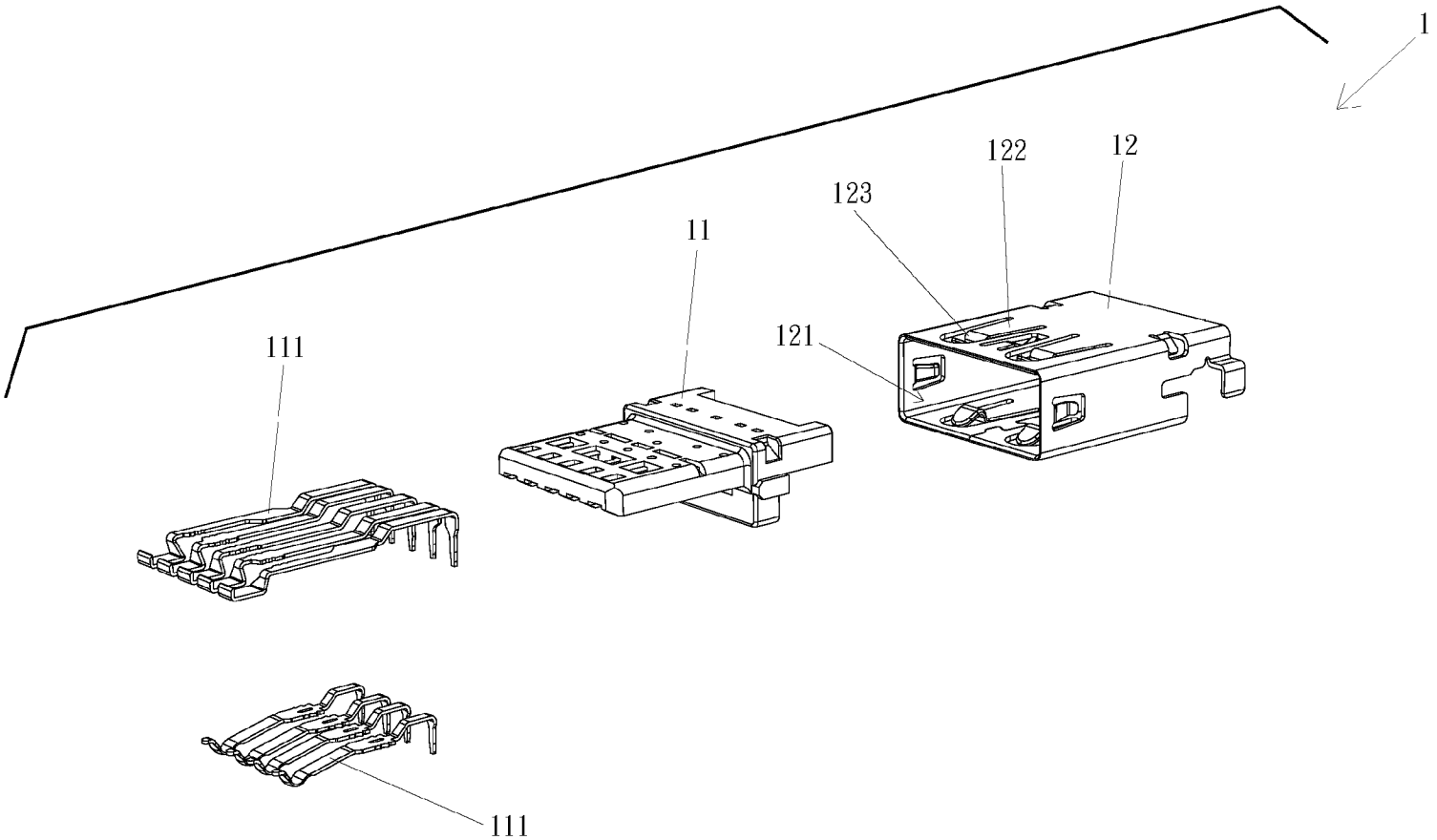
Fig. 1 (Prior Art)
FIG. 1 is an exploded perspective view of a conventional connector socket.
Figure 2:
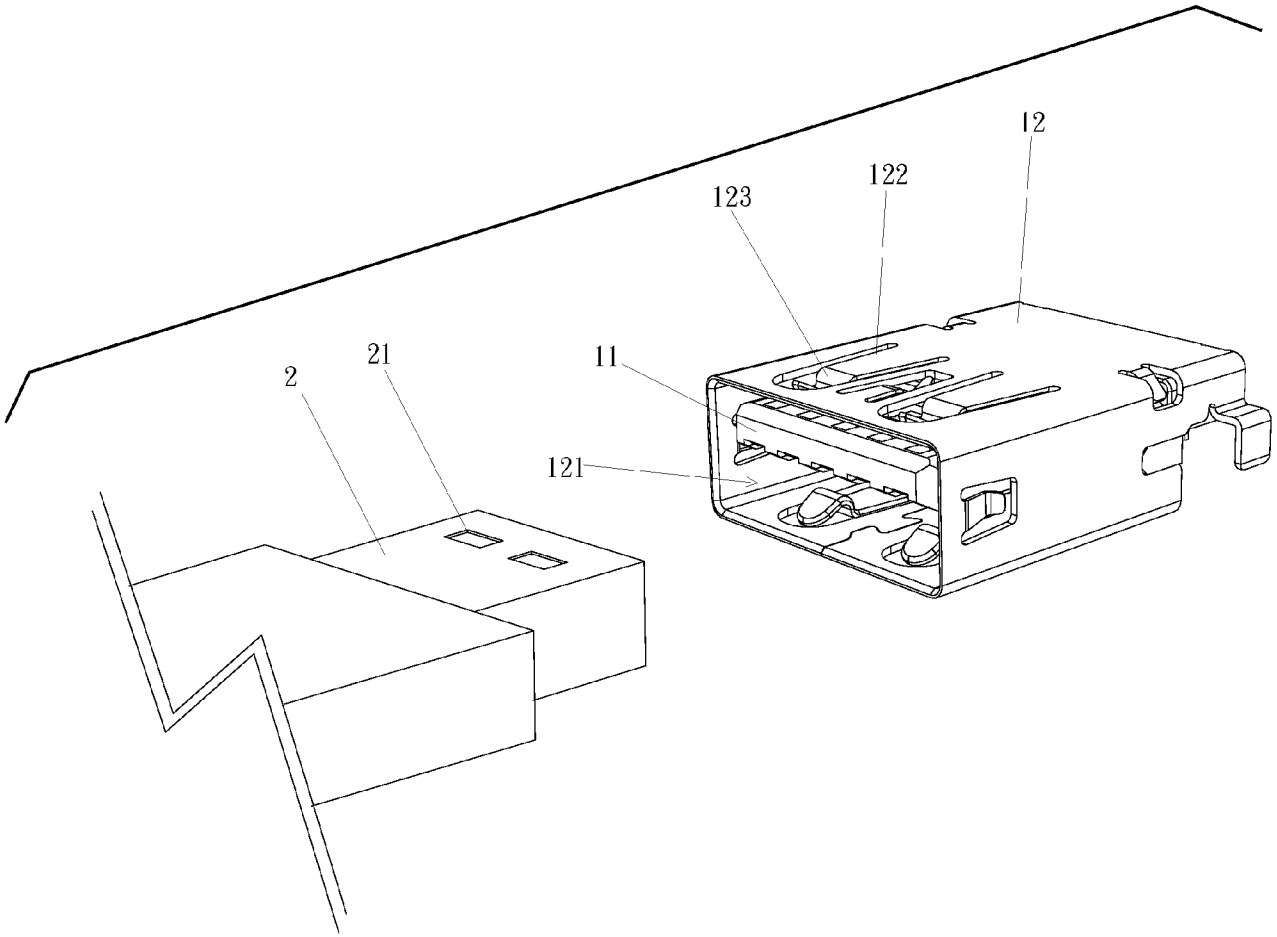
Fig. 2 (Prior Art)
FIG. 2 is a perspective view showing that the conventional connector socket is ready for connection to a connector plug.
Figure 3:
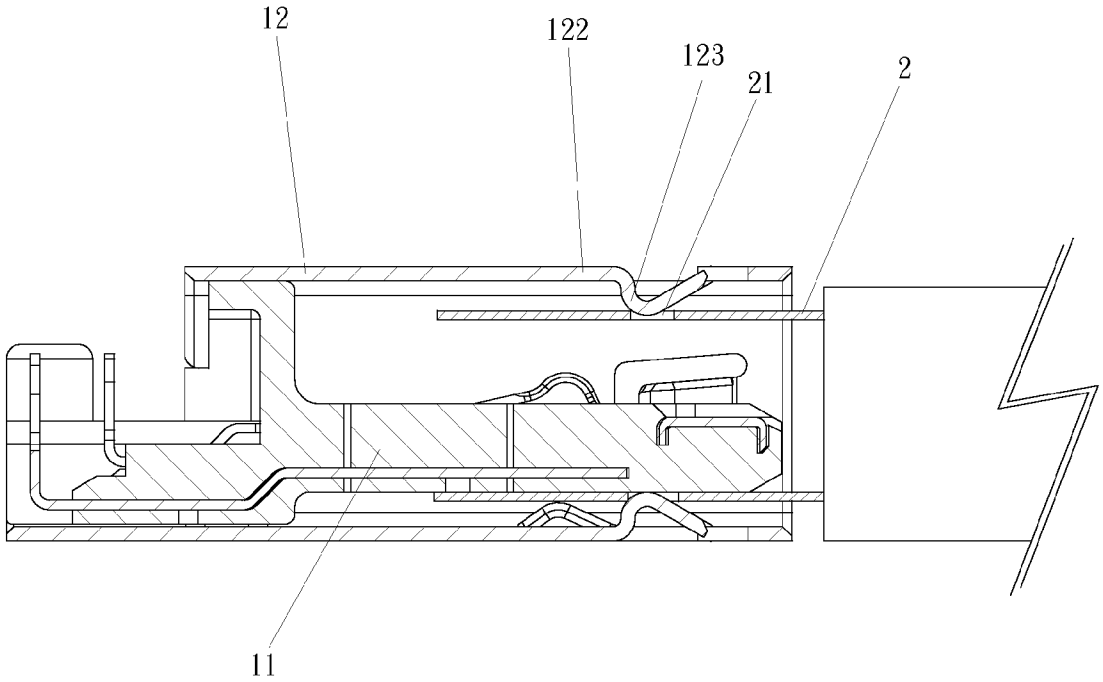
Fig. 3 (Prior Art)
FIG. 3 is a schematic cross sectional view showing the engagement between the connector plug and the conventional connector socket.
Figure 4:
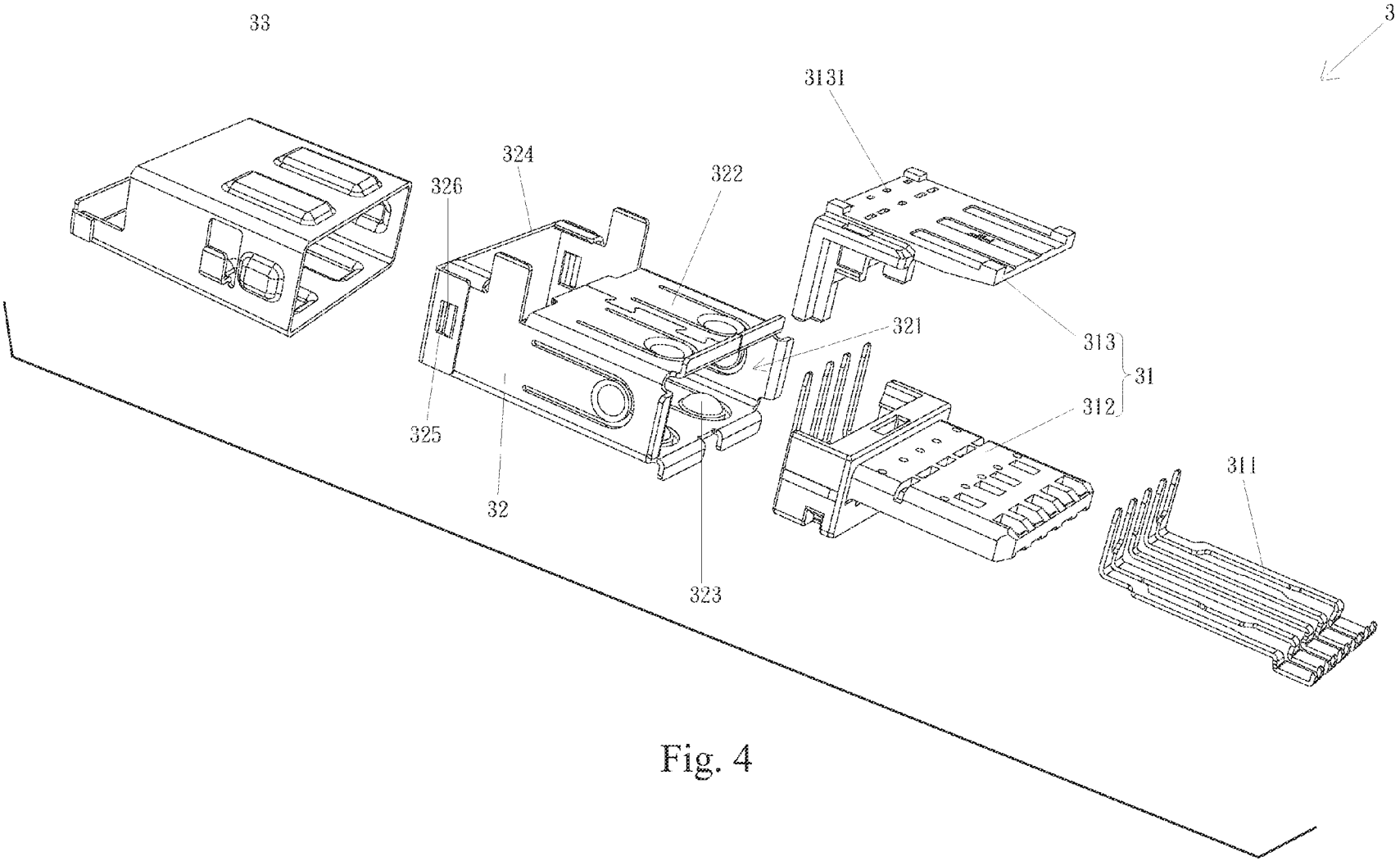
FIG. 4 is an exploded perspective view showing the structure of the connector socket of the present invention.

With reference to FIG. 4, the connector socket constructed in accordance with the preferred embodiment of the present invention is composed of an insulation body 31, a metal body 32 and a blocking casing.

The insulation body 31 is composed of a first body 312 carrying thereon multiple terminals 311 and a second body 313 operably combined with the first body 312 and having multiple holes 3131 for extension of distal free ends of the terminals 311.

The metal body 32 has a receiving hole 321 defined to receive therein the combination of the first body 312 and the second body 313 as well as the terminals 311, spring clip 322 defined in side faces of the metal body and each spring clip 322 having thereon at least one protrusion 323 formed and a baffle 324 formed on a side opposite to where the receiving hole 321 is defined and having clamping holes 325 defined in two opposite sides of the baffle 324 to correspond to clamps 326 provided on two opposite sides of the metal body 32 to be ready to extend through the clamping holes 325 to secure engagement between the baffle 324 and the metal body 32.

Furthermore, it is noted that each of the protrusions 323 is formed by protruding toward the metal body 32 upon each spring clip 322 is forced; each of the protrusions 323 has a arc shaped contact face, such as each of the protrusion 323 is formed to have semi-sphere shape.

The protection casing 33 is designed to receive therein the metal body 32 and the insulation body 31 and made of an insulation material to block any kind of interference going into the insulation body 31 or the metal body 32 to influence the terminal data transmission.

Figure 5:
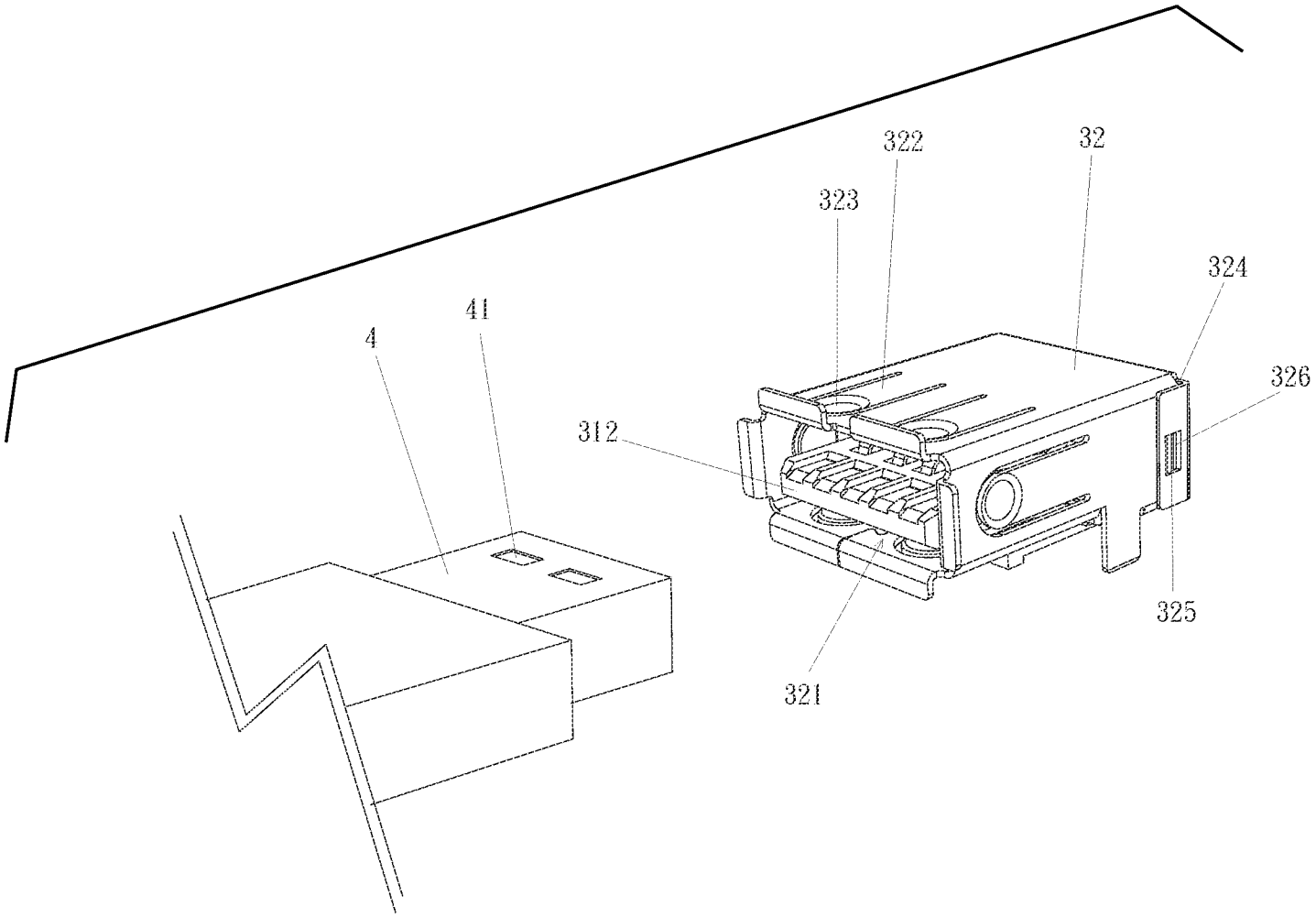
FIG. 5 is a schematic perspective view showing that the connector socket of the present invention is ready for connection to the connector plug.
Figure 6:
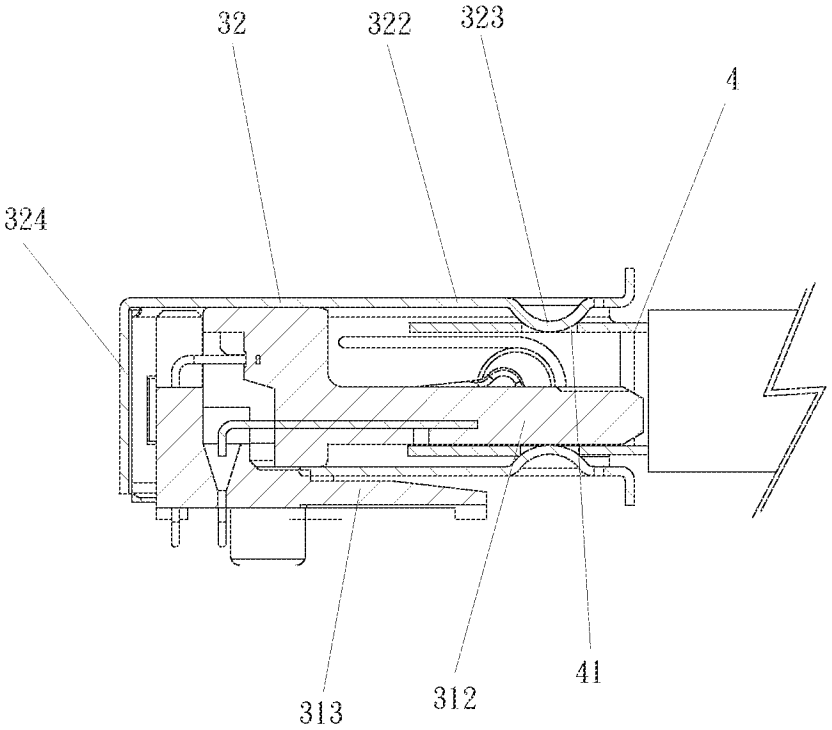
FIG. 6 is a schematic cross section showing the engagement between the connector plug and the connector socket.

With reference to FIGS. 5 and 6, it is to be noted that after the insulation body 31 is successfully received in the metal body 32, the protrusions 323 are all extended toward the space defined by the receiving hole 321. After the aforementioned assembly of the connector socket is completed and ready for connection to a connector plug 4 having multiple windows 41 defined in a head portion thereof in which each window has a plurality of flanges defined around a periphery thereof and each of the flanges is connecting to adjacent flanges, it is to be noted that after the head portion of the connector plug 4 is extended into the receiving hole 321 of the metal body 32, each of the protrusions 323 is aligned with a corresponding one of the windows 41 so that after the protrusions 323 are respectively received in the corresponding windows 41, the arc-shaped contacting face of each of the protrusions 323 is abutted against the flanges of the connector plug 4 to deform, and at least two contacts are formed between the flanges of the connector plug 4 and the protrusions 323 of the connector socket 3, such that the engagement between the connector plug 4 and the connector socket 3 is enhanced. Further, the combination of the protrusions 323 and the windows 41 reduces gap between the connector socket 3 and the connector plug 4 after the connector plug 4 is extended into the connector socket 3, which greatly reduces influences of electromagnetic signals to the terminals 311.

To further enhance the engagement between the connector socket 3 and the connector plug 4, the arc-shaped contacting face of the protrusions 323 may have larger sizes and more numbers formed on each side face of the metal body 32 as the more engaged area, the less the resistance there will be between the metal body 32 and the connector plug 4.

With the provision of the protection casing 33, the influence from the electromagnetic signals to the terminals is blocked.

It is noted from the description that the structure of the present invention has the following advantages:

With the cooperation between the protrusions 323 and the windows 41, the gap between the connector plug 4 and the connector socket 3 is greatly reduced such that electromagnetic signal influence inward to or outward from other electrical devices is greatly reduced. Also, resistance between the connector plug 4 and the connector socket 3 is greatly reduced. To further reduce the influence, the baffle 324 and the protection casing 33 are provided to even reduce the influence of electromagnetic signals.

It is to be noted that although the preferred embodiment of the present invention has been described, other modifications, alterations or minor change to the structure should still be within the scope defined in the claims. As those skilled in the art will readily observe that numerous modifications and alterations of the device and method may be made while retaining the teachings of the invention.

What is claimed is:

1. A connector socket adapted to mate with a connector plug having a head portion with multiple windows defined therein, each window having multiple flanges defined around a periphery thereof, each flange being connected with adjacent flanges, the connector socket comprising:

an insulation body having thereon multiple terminals;

a metal body having a receiving hole defined to receive therein the insulation body, spring clips formed on side faces thereof and having protrusions formed on the spring clips for extension and accommodation in the windows of the connector plug so as to enhance engagement with the connector plug, each of the protrusions having an arc-shaped contacting face; and a protection casing for receiving therein the metal body and the insulation body to block electromagnetic interference to/from the terminals;

wherein when the connector plug is connected to the connector socket, the connector plug is inserted into the connector socket through the receiving hole, and each of the protrusions is aligned with a corresponding one of the windows, so that the arc-shaped contacting face of each of the protrusions is abutted against the flanges of the connector plug to deform, and at least two contacts are formed between the flanges of the connector plug and the protrusions of the connector socket.

2. The connector socket as claimed in claim 1, wherein the insulation body has a first body carrying thereon the multiple terminals and a second body operatably combined with the first body and having multiple holes defined for extension of the terminals.

3. The connector socket as claimed in claim 1, wherein the connector socket is a USB3.0 connector socket.

4. The connector socket as claimed in claim 1, wherein the metal body further has a baffle opposite to where the receiving hole is defined.

5. The connector socket as claimed in claim 4, wherein the baffle has clamping holes and the metal body has clamps formed to extend through the clamping holes to secure engagement of the baffle to the metal body.

6. The connector socket as claimed in claim 1, wherein the protection casing is made of an insulation material.

7. The connector socket as claimed in claim 1, wherein the protrusions are semi-spheres.

* * * * *